US008207099B2

(12) United States Patent
Loper

(10) Patent No.: US 8,207,099 B2
(45) Date of Patent: Jun. 26, 2012

(54) LUBRICATING OIL COMPOSITION FOR CRANKCASE APPLICATIONS

(75) Inventor: John T. Loper, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 162 days.

(21) Appl. No.: 12/564,651

(22) Filed: Sep. 22, 2009

(65) Prior Publication Data

US 2011/0067662 A1 Mar. 24, 2011

(51) Int. Cl.
*C10M 137/10* (2006.01)

(52) U.S. Cl. ..... 508/436; 508/369; 508/371

(58) Field of Classification Search ..... 508/369, 508/371, 436

See application file for complete search history.

(56) References Cited

U.S. PATENT DOCUMENTS

| | | | | |
|---|---|---|---|---|
| 3,219,666 | A | 11/1965 | Norman et al. | |
| 3,565,804 | A | 2/1971 | Honnen et al. | |
| 3,697,574 | A | 10/1972 | Piasek et al. | |
| 3,736,357 | A | 5/1973 | Piasek et al. | |
| 4,203,877 | A * | 5/1980 | Baker | 524/500 |
| 4,234,435 | A | 11/1980 | Meinhardt et al. | |
| 4,259,194 | A | 3/1981 | de Vries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | de Vries et al. | |
| 4,272,387 | A | 6/1981 | King et al. | |
| 4,283,295 | A | 8/1981 | de Vries et al. | |
| 4,285,822 | A | 8/1981 | de Vries et al. | |
| 4,504,276 | A | 3/1985 | Baker | |
| 4,509,950 | A | 4/1985 | Baker | |
| 4,518,512 | A | 5/1985 | Kanamori | |
| 4,636,322 | A | 1/1987 | Nalesnik | |
| 4,702,850 | A | 10/1987 | Gutierrez et al. | |
| 4,776,966 | A | 10/1988 | Baker | |
| 4,867,890 | A | 9/1989 | Colclough et al. | |
| 4,943,672 | A | 7/1990 | Hamner et al. | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,300,291 | B1 | 10/2001 | Hartley et al. | |
| 6,723,685 | B2 | 4/2004 | Hartley et al. | |
| 6,750,185 | B2 | 6/2004 | Ryu et al. | |
| 2002/0038525 | A1 | 4/2002 | Callis et al. | |
| 2004/0266630 | A1 | 12/2004 | George et al. | |
| 2008/0020955 | A1 * | 1/2008 | Diggs et al. | 508/391 |
| 2008/0280791 | A1 | 11/2008 | Hewette | |
| 2009/0054281 | A1 | 2/2009 | Oldfield | |

FOREIGN PATENT DOCUMENTS

| | | |
|---|---|---|
| GB | 0917923 | 2/1963 |

* cited by examiner

*Primary Examiner* — Walter D Griffin
*Assistant Examiner* — Francis C Campanell
(74) *Attorney, Agent, or Firm* — Luedeka Neely Group, P.C.

(57) ABSTRACT

A crankcase lubricant, an additive concentrate and a method for improving water tolerance of a lubricant. The lubricant includes a) a major amount of a base oil; b) an alkali or alkaline earth metal-containing detergent; c) a phosphorus-based wear preventative; and d) a surfactant agent other than (b). The lubricant has a weight ratio of alkali or alkaline earth metal content to phosphorus content, based on a total mass of lubricant, ranging from about 1.6 to about 5.0.

14 Claims, No Drawings

LUBRICATING OIL COMPOSITION FOR CRANKCASE APPLICATIONS

TECHNICAL FIELD

The present disclosure relates to lubricating oil compositions suitable for crankcase application. More particularly, the present invention relates to lubricating oil compositions which improve emulsibility of water in lubricant compositions containing non-metal friction modifiers.

BACKGROUND AND SUMMARY

Crankcase lubricant compositions may be selected to provide an increased engine protection while providing an increase in fuel economy and reduced emissions. However, in order to achieve benefits of improved fuel economy and reduced emissions, a balance between engine protection and lubricating properties is required for the lubricant composition. For example, an increase in the amount of friction modifiers may be beneficial for fuel economy purposes but may lead to reduced ability of the lubricant composition to handle water. Likewise, an increase in the amount of anti-wear agent in the lubricant may provide improved engine protection against wear but may be detrimental to catalyst performance for reducing emissions. Accordingly, there is a need for improved lubricant compositions that are suitable for meeting or exceeding the currently proposed ILSAC GF-5 lubricant performance standards.

In view of the foregoing, the disclosure provides crankcase lubricant that includes a) a major amount of a base oil; b) an alkali or alkaline earth metal-containing detergent; c) a phosphorus-based wear preventative; and d) a surfactant agent other than (b). The lubricant has a weight ratio of alkali or alkaline earth metal content to phosphorus content, based on a total mass of lubricant, ranging from about 1.6 to about 5.0.

In one embodiment, the disclosure provides an additive composition suitable for use in a crankcase lubricant. The additive composition includes a) an alkali or alkaline earth metal-containing detergent; b) a phosphorus-based wear preventative; c) a surfactant agent other than (a); and d) a non-metal friction modifier. The additive composition has a weight ratio of alkali or alkaline earth metal content to phosphorus content ranging from about 1.6 to about 5.0.

Another embodiment of the disclosure provides a method for improving the water tolerance of a crankcase lubricant containing more than about 0.1 percent by weight of a non-metal friction modifier. The method includes combining a major amount of a base oil with an alkali or alkaline earth metal-containing detergent, a phosphorus-based wear preventative, and a surfactant agent having an HLB value ranging from about 4 to about 5.

The following definitions of terms are provided in order to clarify the meanings of certain terms as used herein.

As used herein, the terms "oil composition," "lubrication composition," "lubricating oil composition," "lubricating oil," "lubricant composition," "lubricating composition," "fully formulated lubricant composition," and "lubricant" are considered synonymous, fully interchangeable terminology referring to the finished lubrication product comprising a major amount of a base oil plus a minor amount of an additive composition.

As used herein, the terms "additive package," "additive concentrate," and "additive composition" are considered synonymous, fully interchangeable terminology referring the portion of the lubricating composition excluding the major amount of base oil stock mixture.

As used herein, the term "HLB" means the hydrophilic/lipophilic balance of a surfactant.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

As used herein, the term "percent by weight", unless expressly stated otherwise, means the percentage the recited component represents to the weight of the entire composition.

The terms "oil-soluble" or "dispersible" used herein do not necessarily indicate that the compounds or additives are soluble, dissolvable, miscible, or capable of being suspended in the oil in all proportions. The foregoing terms do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Crankcase lubricating oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil. The fully formulated crankcase lubricant may exhibit improved performance properties, based on the additives added and their respective proportions.

Additional details and advantages of the disclosure will be set forth in part in the description which follows, and/or can be learned by practice of the disclosure. The details and advantages of the disclosure may be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EXEMPLARY EMBODIMENTS

The present disclosure will now be described in the more limited aspects of embodiments thereof, including various examples of the formulation and use of the present disclosure. It will be understood that these embodiments are presented solely for the purpose of illustrating the invention and shall not be considered as a limitation upon the scope thereof.

Crankcase lubricant compositions are used in vehicles containing spark ignition and compression ignition engines. Such engines may be used in automotive and truck applications and may be operated on fuels including, but not limited to, gasoline, diesel, alcohol, compressed natural gas, and the like. The disclosure is directed specifically to crankcase lubricants, and more particularly to automotive crankcase lubricants that meet or exceed the proposed ILSAC GF-5 lubricant standards. Such lubricants have increasingly stringent fuel economy and emissions standards that may require an increase in friction modifiers and a decrease in metal containing anti-wear agents. The friction modifiers may be selected from metal containing friction modifiers, metal free friction modifiers, and a combination of metal-containing and metal-free friction modifiers. The antiwear agents may be selected from ashless antiwear agents, metal containing antiwear agents, and a combination of ashless and metal containing antiwear agents. Other lubricant ingredients may include one or more dispersants, one or more detergents, and one or more antioxidants. A particularly suitable lubricant composition may include a base oil of lubricating viscosity, an alkali or alkaline earth metal detergent, a phosphorus-containing antiwear agent, and a non-dispersant surfactant other than the alkali or alkaline earth metal detergent. The lubricant composition has a weight ratio of alkali or alkaline earth metal content to phosphorus content, based on a total mass of lubricant, ranging from about 1.6 to about 5.0.

Base Oil

Base oils suitable for use in formulating crankcase lubricant compositions may be selected from any of suitable synthetic or natural oils or mixtures thereof. Natural oils may include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale may also be suitable. The base oil typically may have a viscosity of about 2 to about 15 cSt or, as a further example, about 2 to about 10 cSt at 100° C. Further, an oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the crankcase lubricant compositions as described herein may be selected from any of the base oils in Groups I-V as specified in the American Petroleum Institute (API) Base Oil Interchangeability Guidelines. Such base oil groups are as follows:

TABLE 1

| Base Oil Group[1] | Sulfur (wt %) | | Saturates (wt %) | Viscosity Index |
|---|---|---|---|---|
| Group I | >0.03 | And/or | <90 | 80 to 120 |
| Group II | ≦0.03 | And | ≧90 | 80 to 120 |
| Group III | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

The base oil may contain a minor or major amount of a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide a crankcase lubricant composition. Accordingly, the base oil may be present in the crankcase lubricant composition in an amount ranging from about 50 wt % to about 95 wt % based on a total weight of the lubricant composition.

Metal-Containing Detergents

Embodiments of the present disclosure may also comprise at least one metal detergent. Detergents generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from about 0 to less than about 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of about 150 or greater, such as from about 150 to about 450 or more.

Detergents that may be suitable for use in the present embodiments include oil-soluble neutral or overbased sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be neutral or overbased calcium or magnesium sulfonates having a TBN of from 20 to 450 TBN, neutral or overbased calcium or magnesium phenates or sulfurized phenates having a TBN of from 50 to 450, and neutral or overbased calcium or magnesium salicylates having a TBN of from 130 to 350. Mixtures of such salts may also be used.

The metal-containing detergent may be present in a lubricating composition in an amount of from about 0.5 wt % to about 5 wt %. As a further example, the metal-containing detergent may be present in an amount of from about 1.0 wt % to about 3.0 wt %. The metal-containing detergent may be present in a lubricating composition in an amount sufficient to provide from about 500 to about 5000 ppm alkali and/or alkaline earth metal to the lubricant composition based on a total weight of the lubricant composition. As a further example, the metal-containing detergent may be present in a lubricating composition in an amount sufficient to provide from about 1000 to about 3000 ppm alkali and/or alkaline earth metal.

Phosphorus-Based Antiwear Agents

The phosphorus-based wear preventative may comprise a metal dihydrocarbyl dithiophosphate compound, such as but not limited to a zinc dihydrocarbyl dithiophosphate compound. Suitable metal dihydrocarbyl dithiophosphates may comprise dihydrocarbyl dithiophosphate metal salts wherein the metal may be an alkali or alkaline earth metal, or aluminum, lead, tin, molybdenum, manganese, nickel, copper, or zinc.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The zinc dihydrocarbyl dithiophosphates (ZDDP) are oil soluble salts of dihydrocarbyl dithiophosphoric acids and may be represented by the following formula:

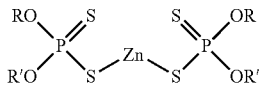

wherein R and R' may be the same or different hydrocarbyl radicals containing from 1 to 18, for example 2 to 12, carbon atoms and including radicals such as alkyl, alkenyl, aryl, arylalkyl, alkaryl, and cycloaliphatic radicals. R and R' groups may be alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates.

Other suitable components that may be utilized as the phosphorus-based wear preventative include any suitable organophosphorus compound, such as but not limited to, phosphates, thiophosphates, di-thiophosphates, phosphites, and salts thereof and phosphonates. Suitable examples are tricresyl phosphate (TCP), di-alkyl phosphite (e.g., dibutyl hydrogen phosphite), and amyl acid phosphate.

Another suitable component is a phosphorylated succinimide such as a completed reaction product from a reaction between a hydrocarbyl substituted succinic acylating agent and a polyamine combined with a phosphorus source, such as inorganic or organic phosphorus acid or ester. Further, it may comprise compounds wherein the product may have amide, amidine, and/or salt linkages in addition to the imide linkage of the type that results from the reaction of a primary amino group and an anhydride moiety.

The phosphorus-based wear preventative may be present in a lubricating composition in an amount sufficient to provide from about 200 to about 2000 ppm phosphorus. As a further example, the phosphorus-based wear preventative may be present in a lubricating composition in an amount sufficient to provide from about 500 to about 800 ppm phosphorus.

The phosphorus-based wear preventative may be present in a lubricating composition in an amount sufficient to provide a ratio of alkali and/or alkaline earth metal content (ppm) based on the total amount of alkali and/or alkaline earth metal in the lubricating composition to phosphorus content (ppm) based on the total amount of phosphorus in the lubricating composition of from about 1.6 to about 3.0 (ppm/ppm).

Surfactants

Lubricating compositions and/or additive packages as described herein may comprise one or more surfactant agents other than the alkali or alkaline earth metal detergent described above. The surfactant may be an ionic or non-ionic surfactant. A particularly suitable surfactant is a non-ionic surfactant. Examples of a series of suitable surfactant agents are the surfactants derived from a polycarboxylic acid and a polyglycols having a hydrophilic/lipophilic balance (HLB) ranging from about 3 to about 6. Suitable surfactants are described, for example, in U.S. Pat. Nos. 4,504,276; 4,509,950; and 4,776,966, herein incorporated by reference.

In general terms, the surfactant agents may be block or graft co-polymers of the general formula $(A\text{-}COO)_mB$, where m is an integer of at least 2 and, A is a polymeric component having a molecular weight of at least about 500 and is the residue of an oil-soluble complex mono-carboxylic acid of the general structural formula:

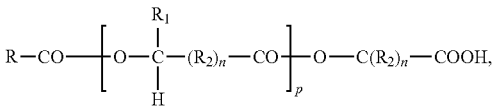

in which R is hydrogen or a monovalent hydrocarbon or substituted hydrocarbon group, $R_1$ is hydrogen or a monovalent $C_1$ to $C_{24}$ hydrocarbon group, $R_2$ is a divalent $C_1$ to $C_{24}$ hydrocarbon group, n is zero or 1 and p is zero or an integer of up to about 200; and (b) B is a polymeric component having a molecular weight of at least about 500 and, in the case where m is 2, is the divalent residue of a water-soluble polyalkylene glycol of the general formula:

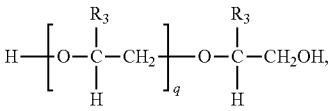

in which $R_3$ is hydrogen or a $C_1$ to $C_3$ alkyl group, q is an integer from about 10 to about 500, or, in the case where m is greater than 2, is the residue of valency m of a water-soluble polyether polyol of the general formula:

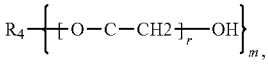

in which $R_3$ and m have their previous significance, r is zero or an integer from 1 to 500, provided that the total number of

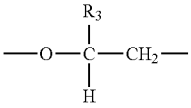

units in the molecule is at least about 10, and $R_4$ is the residue of an organic compound containing in the molecule m hydrogen atoms reactive with an alkylene oxide.

Suitable surfactants may comprise molecules having repeating hydrophilic and hydrophobic units. Such surfactants tend to occupy a stable position at an interface between oil and water thereby producing emulsions of high stability and controllable droplet size. When positioned at the interface, the extensive interactions of the polymer ensure a superior colloidal stability against coagulation or coalescence. In the surfactants described above, the hydrophilic portion of the molecule acts as an anchor group in the water phase and the hydrophobic polymeric chain portion penetrates into the oil providing a static stabilization barrier preventing strong interaction between droplets. For efficient static stabilization, the chemical structure of the polymeric chain required is determined by compatibility with the non-aqueous medium to be used. In addition the polymeric chain must have a molecular weight designed to the give optimum-size steric stabilization barrier. In principle, an almost infinite number of polymeric structures are suitable as sterically stabilizing surfactants. These include the following five basic structures: PEG alkyds with a fatty acid hydrophobe and polyethylene glycol hydrophile; long chain alkylene hydrophobe and polyethylene glycol hydrophile; polyhydroxy fatty acid hydrophobe and polyethylene glycol hydrophile; polymethacrylate hydrophobe and alkoxy polyethylene glycol hydrophile; and long-chain alkylene hydrophobe and anionic/nonionic (various) hydrophile. Examples of suitable surfactants include one of or combinations of one or more of surfactants having an HLB (hydrophilic/lipophilic balance) of ranging from about 3 to about 6.

Friction Modifiers

Embodiments of the present disclosure may include one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, and the like.

Suitable friction modifiers may contain hydrocarbyl groups that are selected from straight chain, branched chain, or aromatic hydrocarbyl groups or admixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms and may be saturated or unsaturated.

Aminic friction modifiers may include amides of polyamines. Such compounds can have hydrocarbyl groups that are linear, either saturated or unsaturated, or a mixture thereof and may contain from about 12 to about 25 carbon atoms.

Further examples of suitable friction modifiers include alkoxylated amines and alkoxylated ether amines. Such compounds may have hydrocarbyl groups that are linear, either saturated, unsaturated, or a mixture thereof They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference.

Other suitable friction modifiers may include an organic, ashless (metal-free), nitrogen-free organic friction modifier. Such friction modifiers may include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Another example of an organic ashless nitrogen-free friction modifier is known generally as glycerol monooleate (GMO) which may contain mono- and diesters of oleic acid. Other suitable friction modifiers are described in U.S. Pat. No. 6,723,685, herein incorporated by reference. The ashless friction modifier may be present in the lubricant composition in an amount ranging from about 0.1 to about 0.4 percent by weight based on a total weight of the lubricant composition.

Suitable friction modifiers may also include one or more molybdenum compounds. The molybdenum compound may be selected from the group consisting of molybdenum dithiocarbamates (MoDTC), molybdenum dithiophosphates, molybdenum dithiophosphinates, molybdenum xanthates, molybdenum thioxanthates, molybdenum sulfides, a trinuclear organo-molybdenum compound, molybdenum/amine complexes, and mixtures thereof.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Suitable molybdenum dithiocarbamates may be represented by the formula:

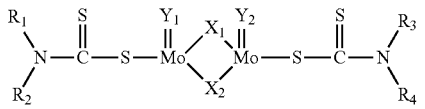

where $R_1$, $R_2$, $R_3$, and $R_4$ each independently represent a hydrogen atom, a $C_1$ to $C_{20}$ alkyl group, a $C_6$ to $C_{20}$ cycloalkyl, aryl, alkylaryl, or aralkyl group, or a $C_3$ to $C_{20}$ hydrocarbyl group containing an ester, ether, alcohol, or carboxyl group; and $X_1$, $X_2$, $Y_1$, and $Y_2$ each independently represent a sulfur or oxygen atom.

Examples of suitable groups for each of $R_1$, $R_2$, $R_3$, and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. $R_1$ to $R_4$ may each have $C_6$ to $C_{18}$ alkyl groups. $X_1$ and $X_2$ may be the same, and $Y_1$ and $Y_2$ may be the same. $X_1$ and $X_2$ may both comprise sulfur atoms, and $Y_1$ and $Y_2$ may both comprise oxygen atoms.

Further examples of molybdenum dithiocarbamates include $C_6$-$C_{18}$ dialkyl or diaryldithiocarbamates, or alkylaryldithiocarbamates such as dibutyl-, diamyl-di-(2-ethylhexyl)-, dilauryl-, dioleyl-, and dicyclohexyl-dithiocarbamate.

Another class of suitable organo-molybdenum compounds are trinuclear molybdenum compounds, such as those of the formula $Mo_3S_kL_nQ_z$ and mixtures thereof, wherein L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference.

The molybdenum compound may be present in a fully formulated crankcase lubricant in an amount to provide about 5 ppm to 200 ppm molybdenum. As a further example, the molybdenum compound may be present in an amount to provide about 50 to 100 ppm molybdenum.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate may take advantage of the mutual compatibility afforded by the combination of ingredients when in the form of an additive concentrate. Also, the use of a concentrate may reduce blending time and may lessen the possibility of blending errors.

The present disclosure provides novel lubricating oil blends specifically formulated for use as automotive crankcase lubricants. Embodiments of the present disclosure may provide lubricating oils suitable for crankcase applications and having improvements in the following characteristics: antioxidancy, antiwear performance, rust inhibition, fuel economy, water tolerance, air entrainment, and foam reducing properties.

Anti-foam Agents

In some embodiments, a foam inhibitor may form another component suitable for use in the compositions. Foam inhibitors may be selected from silicones, polyacrylates, and the like. The amount of antifoam agent in the crankcase lubricant formulations described herein may range from about 0.001 wt % to about 0.1 wt % based on the total weight of the formulation. As a further example, antifoam agent may be present in an amount from about 0.004 wt % to about 0.008 wt %.

Dispersant Components

Dispersants contained in the lubricant composition may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936, 041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used include sterically hindered phenols and esters thereof, diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylenebis(2,6-di-tert-butylphenol) and mixtures thereof as described in U.S Publication No. 2004/0266630.

Diarylamine antioxidants include, but are not limited to diarylamines having the formula:

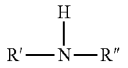

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyldiphenylamine; p-oriented styrenated diphenylamine; mixed butyloctyldi-phenylamine; and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is desirable that the sulfurized olefin or sulfurized fatty oil to deliver between 200 ppm and 2000 ppm sulfur to the finished lubricant.

In general terms, a suitable crankcase lubricant may include additive components in the ranges listed in the following table.

TABLE 2

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophosphate | 0.1-6.0 | 0.1-4.0 |
| Ash-free amine phosphate salt | 0.0-6.0 | 0.0-4.0 |
| Antifoaming agent | 0-5.0 | 0.001-0.15 |
| Supplemental antiwear agents | 0-1.0 | 0-0.8 |
| Pour point depressant | 0.01-5.0 | 0.01-1.5 |

TABLE 2-continued

| Component | Wt. % (Broad) | Wt. % (Typical) |
|---|---|---|
| Viscosity modifier | 0.01-20.00 | 0.25-10.0 |
| Supplemental friction modifier' | 0-2.0 | 0.1-1.0 |
| Base oil | Balance | Balance |
| Total | 100 | 100 |

In order to demonstrate the benefits and advantages of lubricant compositions according to the disclosure, the following non-limiting examples are provided.

EXAMPLES

Emulsion Test

In order to evaluate lubricant formulations according to the disclosure, an E85 emulsion test was conducted on lubricant compositions to determine the weight percent water the lubricant composition could emulsify. The higher the percent emulsion, the greater the ability of the lubricant composition to handle water. In general, during the emulsification test, a quantity of a test fluid and a quantity of distilled water is combined and mechanically mixed in a graduated cylinder and held at a constant temperature, such as a temperature within the range of from about 15° C. to about 30° C., for 24 hours±10 minutes. The graduated cylinder is then observed and measurements recorded of the volume of sample fluid, water, and emulsion layers present. If no water layer is present after about 24 hours, the sample fluid receives a score of 0 (zero), indicating complete emulsion after about 24 hours. If three mL of water has visibly separated then the sample fluid would receive a score of three (3) indicating that the fluid had failed to emulsify three mL of water.

Test Fluids

Test fluids were prepared and tested in the Emulsion test using a surfactant according to the disclosure with a range of treat rates and a range of amounts of metal-free friction modifier in the lubricant formulation. Each of the test lubricants were fully formulated lubricants having a weight ratio of alkali or alkaline earth metal detergent to phosphorus ranging from about 1.6:1 to about 3.0:1. Each of the emulsion tests was conducted at 20° C. for 24 hours. In table 3, the amount of metal-free friction modifier was varied from 0.2 to 0.4 weight and the weight percent surfactant having an HLB value of 4-5 was varied from 0 to 0.2 weight percent as shown below.

TABLE 3

| Test No. | Metal-Free Friction Modifier (wt. %) | Surfactant (wt. %) | HLB | Vol % Oil | Vol. % Emulsion | Vol. % Water | Pass/Fail |
|---|---|---|---|---|---|---|---|
| 1 | 0.4 | 0 | 0 | 2 | 90 | 8 | Fail |
| 2 | 0.4 | 0.10 | 4-5 | 80 | 20 | 0 | Pass |
| 3 | 0.4 | 0.15 | 4-5 | 60 | 40 | 0 | Pass |
| 4 | 0.4 | 0.20 | 4-5 | 30 | 70 | 0 | Pass |
| 5 | 0.3 | 0.10 | 4-5 | 70 | 30 | 0 | Pass |
| 6 | 0.2 | 0.10 | 4-5 | 80 | 20 | 0 | Pass |

As indicated in the foregoing table, the surfactant according to the disclosure produced passing results when using as little as 0.10 weight percent of surfactant even with an amount of metal free friction modifier up to 0.4 weight percent. According to the foregoing example, a surfactant having an HLB value of about 4-5 and having a treat rate about 0.1 provides suitable emulsibility of water in an E85 engine test for a lubricant composition containing from 0.1 to 0.4 weight percent of metal-free friction modifier.

As set forth above, the surfactant according to the disclosure is a non-ionic surfactant derived from a polycarboxylic acid and a polyglycols. The surfactant has an HLB value of 4-5. Surfactants having HLB values outside of the foregoing range and/or surfactants derived from ethoxylated copolymers in a lubricant composition containing 0.1 weight percent or more the metal-free friction modifier are expected to fail the E85 engine emulsion test. In the following table, the surfactant according to the disclosure (Surfactant No. 1) was compared with other surfactants having HLB values outside of the range of 4-5.

TABLE 4

| Surfactant No. | Surfactant (wt. %) | HLB | Metal-Free Friction Modifier (wt. %) | Pass/Fail |
|---|---|---|---|---|
| 1 | 0.1 | 4-5 | 0.2 | Pass |
| 2 | 0.1 | 3-4 | 0.2 | Fail |
| 2 | 0.1 | 3-4 | 0.1 | Pass |
| 3 | 0.1 | 6 | 0.1 | Fail |
| 3 | 0.1 | 6 | 0.3 | Fail |
| 6 | 0.5 | 7.8 | 0.1 | Fail |
| 7 | 0.5 | 9.8 | 0.1 | Fail |
| 8 | 0.5 | 12.4 | 0.1 | Fail |
| 9 | 0.5 | 14.4 | 0.1 | Fail |
| 10 | 0.5 | 12.3 | 0.1 | Fail |
| 11 | 0.5 | 8.9 | 0.1 | Fail |
| 12 | 0.5 | 10.9 | 0.1 | Fail |
| 13 | 0.5 | 12.0 | 0.1 | Fail |
| 14 | 0.5 | 12.6 | 0.1 | Fail |

In the foregoing examples, surfactant No. 2 provided a pass at 0.1 weight percent metal-free friction modifier, but failed at 0.2 weight percent of the friction modifier. All of the other surfactants failed even at 0.1 weight percent of the metal-free friction modifier, whereas, as shown in Table 3, Surfactant No. 1, according to the disclosure provided a passing result with amount of metal-free friction modifier ranging from 0.2 to 0.4 weight percent in the lubricant composition even at 0.1 weight percent of the surfactant.

At numerous places throughout this specification, reference has been made to a number of U.S. patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A crankcase lubricant, comprising:

a) a major amount of a base oil;

b) an alkali or alkaline earth metal-containing detergent;

c) a phosphorus-based wear preventative;

d) a surfactant agent having an HLB value ranging from about 4 to about 5 comprising a block or graft co-polymer of the general formula $(A\text{-}COO)_mB$, where m in an integer of at least 2 and, A is a polymeric component having a molecular weight of at least 500 and is the residue of an oil-soluble complex mono-carboxylic acid of the general structural formula:

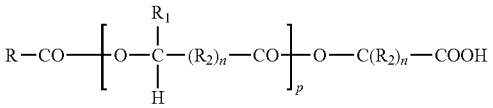

in which R is hydrogen or a monovalent hydrocarbon or substituted hydrocarbon group, $R_1$ is hydrogen or a monovalent $C_1$ to $C_{24}$ hydrocarbon group, $R_2$ is a divalent $C_1$ to $C_{24}$ hydrocarbon group, n is zero or 1 and p is zero or an integer of up to 200; and B is a polymeric component having a molecular weight of at least 500 and, in the case where m is 2, is the divalent residue of a water-soluble polyalkylene glycol of the general formula:

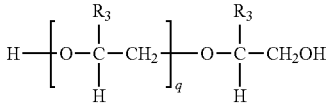

in which $R_3$ is hydrogen or a $C_1$ to $C_3$ alkyl group, q is an integer from 10 to 500, or, in the case where m is greater than 2, is the residue of valency m of a water-soluble polyether polyol of the general formula:

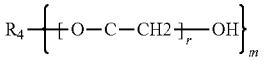

in which $R_3$ and m have their previous significance, r is zero or an integer from 1 to 500, provided that the total number of

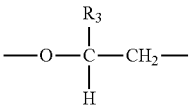

units in the molecule is at least 10, and $R_4$ is the residue of an organic compound containing in the molecule m hydrogen atoms reactive with an alkylene oxide: and e) more than about 0.10 weight percent of a monoester of a $C_5$ to $C_{30}$ carboxylic acid as a non-metal friction modifier, wherein the lubricant has a weight ratio of alkali or alkaline earth metal content to phosphorus content, based on a total mass of lubricant, ranging from about 1.6 to about 5.0, and wherein the lubricant passes an E85 emulsion test.

2. The crankcase lubricant according to claim 1, wherein the phosphorus-based wear preventative comprises at least one zinc dihydrocarbyl dithiophosphate compound.

3. The crankcase lubricant according to claim 2, wherein the composition contains from about 200 to about 1000 ppm phosphorus from the zinc dihydrocarbyl dithiophosphate compound.

4. The crankcase lubricant according to claim 3, wherein the composition contains from about 300 to 800 ppm phosphorus from the zinc dihydrocarbyl dithiophosphate compound.

5. The crankcase lubricant according to claim 1, wherein the composition contains from about 1000 ppm to about 3000 ppm metal from the metal-containing detergent.

6. The crankcase lubricant according to claim 1, further comprising at least one component selected from the group consisting of: an extreme pressure agent, an antiwear agent, a friction modifier, a dispersant, a defoamant, and an antioxidant.

7. An additive composition suitable for use in a crankcase lubricant, comprising:

a) an alkali or alkaline earth metal-containing detergent;

b) a phosphorus-based wear preventative;

c) a surfactant agent having an HLB value ranging from about 4 to about 5 comprising a block or graft co-polymer of the general formula $(A\text{-}COO)_mB$, where m in an integer of at least 2 and, A is a polymeric component having a molecular weight of at least 500 and is the residue of an oil-soluble complex mono-carboxylic acid of the general structural formula:

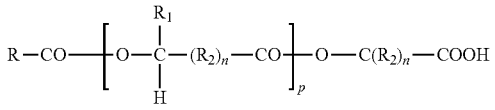

in which R is hydrogen or a monovalent hydrocarbon or substituted hydrocarbon group, $R_1$ is hydrogen or a monovalent $C_1$ to $C_{24}$ hydrocarbon group, $R_2$ is a divalent $C_1$ to $C_{24}$ hydrocarbon group, n is zero or 1 and p is zero or an integer of up to 200; and B is a polymeric component having a molecular weight of at least 500 and, in the case where m is 2, is the divalent residue of a water-soluble polyalkylene glycol of the general formula:

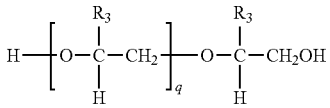

in which $R_3$ is hydrogen or a $C_1$ to $C_3$ alkyl group, q is an integer from 10 to 500, or, in the case where m is greater than 2, is the residue of valency m of a water-soluble polyether polyol of the general formula:

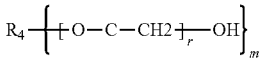

in which $R_3$ and m have their previous significance, r is zero or an integer from 1 to 500, provided that the total number of

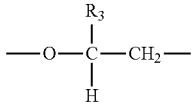

units in the molecule is at least 10, and $R_4$ is the residue of an organic compound containing in the molecule m hydrogen atoms reactive with an alkylene oxide; and d) more than about 0.10 weight percent of a monoester of a $C_5$ to $C_{30}$ carboxylic acid as a non-metal friction modifier, wherein the additive composition has a weight ratio of alkali or alkaline earth metal content to phosphorus content ranging from about 1.6 to about 5.0, and wherein the lubricant passes an E85 emulsion test.

8. The additive composition according to claim 7, wherein the metal detergent is an overbased calcium sulfonate.

9. The additive composition according to claim 7, wherein the phosphorus-based wear preventative comprises at least one zinc dihydrocarbyl dithiophosphate compound.

10. The additive composition according to claim 7, further comprising at least one component selected from the group consisting of: an extreme pressure agent, an antiwear agent, a friction modifier, a dispersant, a defoamant, and an antioxidant.

11. A method for improving the water tolerance of a crankcase lubricant containing more than about 0.1 percent by weight of a monoester of a $C_5$ to $C_{30}$ carboxylic acid as a non-metal friction modifier, comprising combining a major amount of a base oil with an alkali or alkaline earth metal-containing detergent, a phosphorus-based wear preventative, and a surfactant agent having an HLB value ranging from about 4 to about 5 comprising a block or graft co-polymer of the general formula $(A\text{-}COO)_mB$, where m in an integer of at least 2 and, A is a polymeric component having a molecular weight of at least 500 and is the residue of an oil-soluble complex mono-carboxylic acid of the general structural formula:

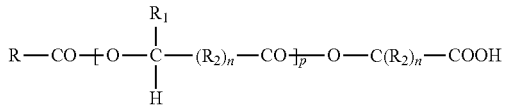

in which R is hydrogen or a monovalent hydrocarbon or substituted hydrocarbon group, $R_1$ is hydrogen or a monovalent $C_1$ to $C_{24}$ hydrocarbon group, $R_2$ is a divalent $C_1$ to $C_{24}$ hydrocarbon group, n is zero or 1 and p is zero or an integer of up to 200; and B is a polymeric component having a molecular weight of at least 500 and, in the case where m is 2, is the divalent residue of a water-soluble polyalkylene glycol of the general formula:

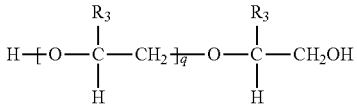

in which $R_3$ is hydrogen or a $C_1$ to $C_3$ alkyl group, q is an integer from 10 to 500, or, in the case where m is greater than 2, is the residue of valency m of a water-soluble polyether polyol of the general formula:

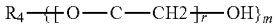

in which $R_3$ and m have their previous significance, r is zero or an integer from 1 to 500, provided that the total number of

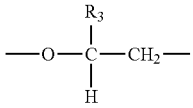

units in the molecule is at least 10, and $R_4$ is the residue of an organic compound containing in the molecule m hydrogen atoms reactive with an alkylene oxide, wherein the lubricant passes an E85 emulsion test.

12. The method of claim 11 wherein the lubricant has a weight ratio of alkali and/or alkaline earth metal content to phosphorus content, based on total mass of the lubricant, ranging from about 1.6 to about 5.0.

13. The method of claim 11, wherein the surfactant is derived from polystearic acid and polyglycols.

14. The method of claim 11, wherein the lubricant comprises from about 0.10 to about 0.5 weight percent of the monoester based on a total weight of the lubricant composition.

* * * * *